United States Patent [19]

Hudson

[11] 4,221,269

[45] Sep. 9, 1980

[54] PIPE SPINNER

[76] Inventor: Ray E. Hudson, 118 O'Michael Bldg., Odessa, Tex. 79761

[21] Appl. No.: 967,586

[22] Filed: Dec. 8, 1978

[51] Int. Cl.[2] ..... E21B 3/00

[52] U.S. Cl. ..... 173/163; 81/57.2

[58] Field of Search ..... 173/163; 81/57.33, 57.43, 81/57.17, 57.2, 57.44, 57.15, 57.16

[56] References Cited

U.S. PATENT DOCUMENTS

| | | | |
|---|---|---|---|
| 2,746,329 | 5/1956 | Paget | 81/57.14 |
| 2,928,301 | 3/1960 | Beeman et al. | 81/57.19 |
| 2,985,455 | 5/1961 | Powell | 81/57.44 X |
| 3,122,211 | 2/1964 | Wilson et al. | 173/164 |
| 3,390,726 | 7/1968 | Bartog | 173/163 |
| 4,099,429 | 7/1978 | Hauk | 81/57.17 |

*Primary Examiner*—Ronald Feldbaum
*Attorney, Agent, or Firm*—Wendell Coffee

[57] ABSTRACT

A pipe spinner for spinning drill pipe as used to dig deep wells includes a yoke with a torque arm. Three self-contained rotary hydraulic motors having urethane coated rollers on the exterior thereof are mounted upon the spinner, one in the central area of the yoke and one each on a swing arm pivoted to the end of the legs on the yoke. Hydraulic fluid for the three motors is supplied and removed axially thereof. The hydraulic fluid conduits are made flexible at the pivots.

14 Claims, 4 Drawing Figures

PIPE SPINNER

BACKGROUND OF THE INVENTION (1) Field of the Invention

This invention relates to tools and more particularly to a machine wrench for round work.

(2) Description of the Prior Art

In the drilling of oil wells, and other oil field work, it is often necessary to run pipe or drill stem in and out of the well. In drilling wells, when it is necessary to remove the drill stem from the well, one or more sections of drill stem are pulled from the well and the joint "broken" or initially loosened by tongs. Thereafter, the sections are spun loose to completely disconnect the joint. The disconnected joint or joints are then moved to one side and another section or sections are lifted from the well.

Basically, the same steps are performed in reverse to place pipe or drill stem in a well.

Oil drilling industry requires extremely rugged equipment not only are the loads and the forces on the equipment very great, but also because of the urgent need to operate the equipment often times it receives rough handling in being roughly used and the equipment itself dropped or sometimes other pieces of equipment dropped upon top of it.

A traditional way of spinning the drill stem or the pipe is to wrap a chain around the pipe and then pull the chain, thereby spinning the pipe.

It will be understood that often times the drill stem or pipe is stressed to near its limit. Therefore, it is desirable not to damage the surface of the pipe inasmuch as this in itself will inherently weaken the point where toothed jaws bite deeply into the pipe. Furthermore, often the pipe is coated to prevent corrosion or damage.

Many of the prior art devices engage the pipe for spinning with toothed jaws or chains which tend to damage the surface of the pipe being spun.

Before this patent application was filed, a search was made in the United States Patent and Trademark Office which showed the following patents:

Mason U.S. Pat. No. 3,086,413

Wilson et al. U.S. Pat. No. 3,122,211

Campbell U.S. Pat. No. 3,380,323

Duke et al. U.S. Pat. No. 3,521,509

WILSON ET AL. discloses a pipe spinner for such use. The spinner spins the pipe by three rollers bearing against the pipe, one of which is hydraulically actuated against the pipe. The three rollers are driven by a chain drive from a single hydraulic rotary motor.

It appears that the other three patents are no more pertinent than the WILSON ET AL. patent.

SUMMARY OF THE INVENTION (1) New and Different Function

I have invented a pipe spinner which is extremely compact and light in weight yet rugged and able to withstand the rough treatment that equipment of this nature may be expected to receive.

Specifically, I have achieved this by having each roller driven by a hydraulic rotary motor co-axial with the roller and mounted within the roller. In this manner, I can provide the necessary torque for the three rollers and not have the weight of chain drives to the three rollers together with the necessary support required by the three rollers. The equipment also has the advantage over other type equipment using chains or jaws to engage the pipe inasmuch as the pipe is not damaged.

Further, I have found that by coating the rollers with a urethane resin coating it gives a very good contact between the rollers and the pipe yet is a very tough coating on the rollers with no damage to the pipe.

Therefore, it may be seen that I have invented an improved pipe spinner, the total function of which far exceeds the sum of the functions of the individual motors, rollers, pivots and other elements.

(2) Objects of this Invention

An object of this invention is to spin pipe.

Further objects are to achieve the above with a device that is sturdy, compact, durable, lightweight, simple, safe, efficient, versatile, ecologically compatible, energy conserving, and reliable, yet inexpensive and easy to manufacture, adjust, operate and maintain.

Other objects are to achieve the above with a method that is versatile, ecologically compatible, energy conserving, rapid, efficient, and inexpensive, and does not require highly skilled people to adjust, operate, and maintain.

The specific nature of the invention, as well as other objects, uses, and advantages thereof, will clearly appear from the following description and from the accompanying drawing.

DESCRIPTION OF THE PREFERRED EMBODIMENT

Figure 1:
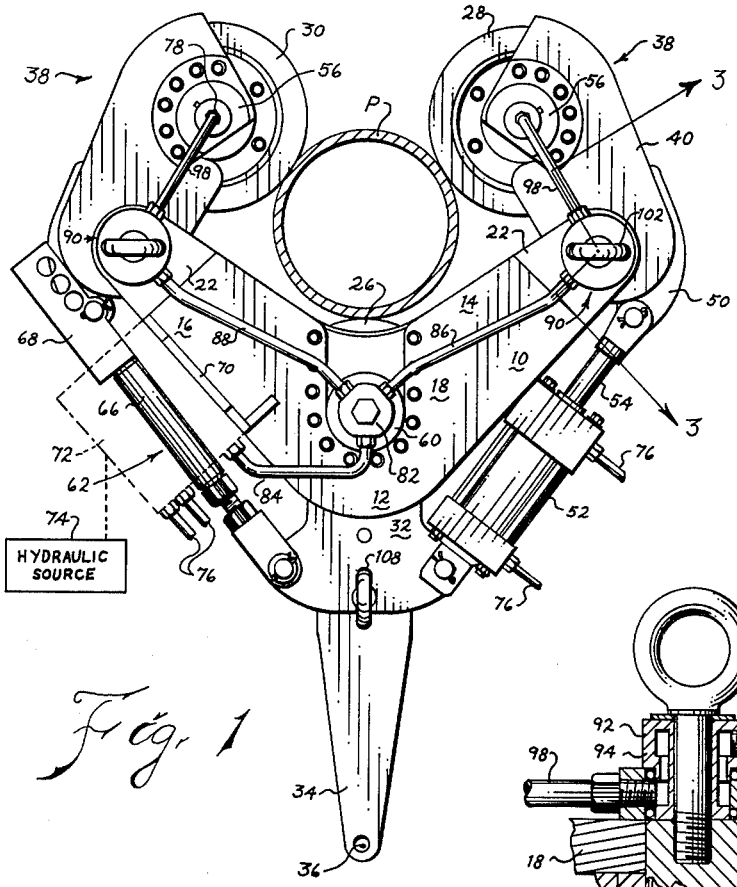
FIG. 1 is a top plan view of a pipe and a spinner according to my invention with the valve manifold schematically represented by dashed lines.
Figure 2:
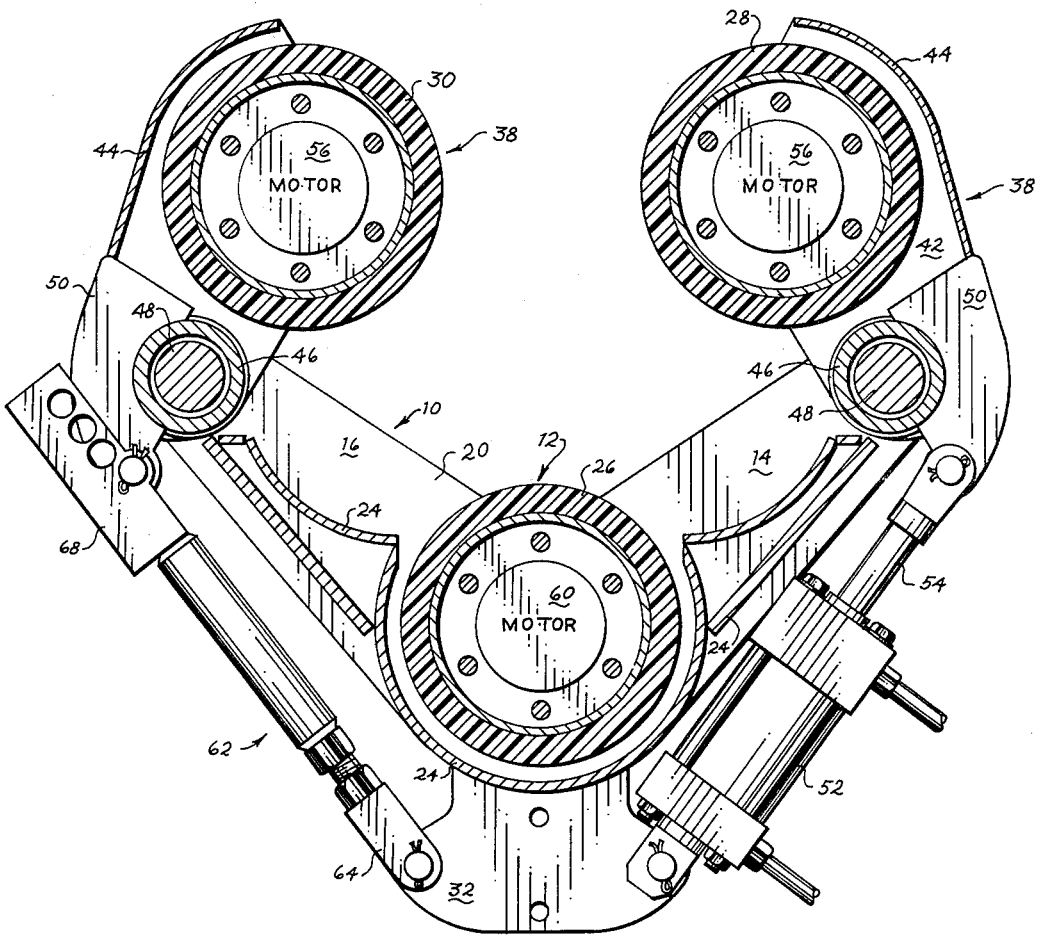
FIG. 2 is a sectional view of the spinner, taken substantially on line 2—2 of FIG. 4.

Referring to the drawings, and more particularly to FIG. 1, there may be seen a pipe spinner, the main purpose of which is to spin pipe P. The main structural feature of the spinner is yoke 10. The yoke 10 has the central area 12 from which projects right leg 14 and left leg 16. The main yoke is constructed to top plate 18 and bottom plate 20 having the shape as seen in FIGS. 1 and 2. The plates are thickened at the end of the legs for forming the pivots 22.

The top and bottom plates are spaced apart by reinforced spacers 24. These reinforced spacers are mainly made from segments of casing, i.e., segments of a cylinder. Some plates are used in making the reinforced spacers 24. It will be noted that the main yoke 10 is basically open, the inside or front or pipe side of the yoke to receive main roller 26, the right roller 28 and the left roller 30.

Figure 4:
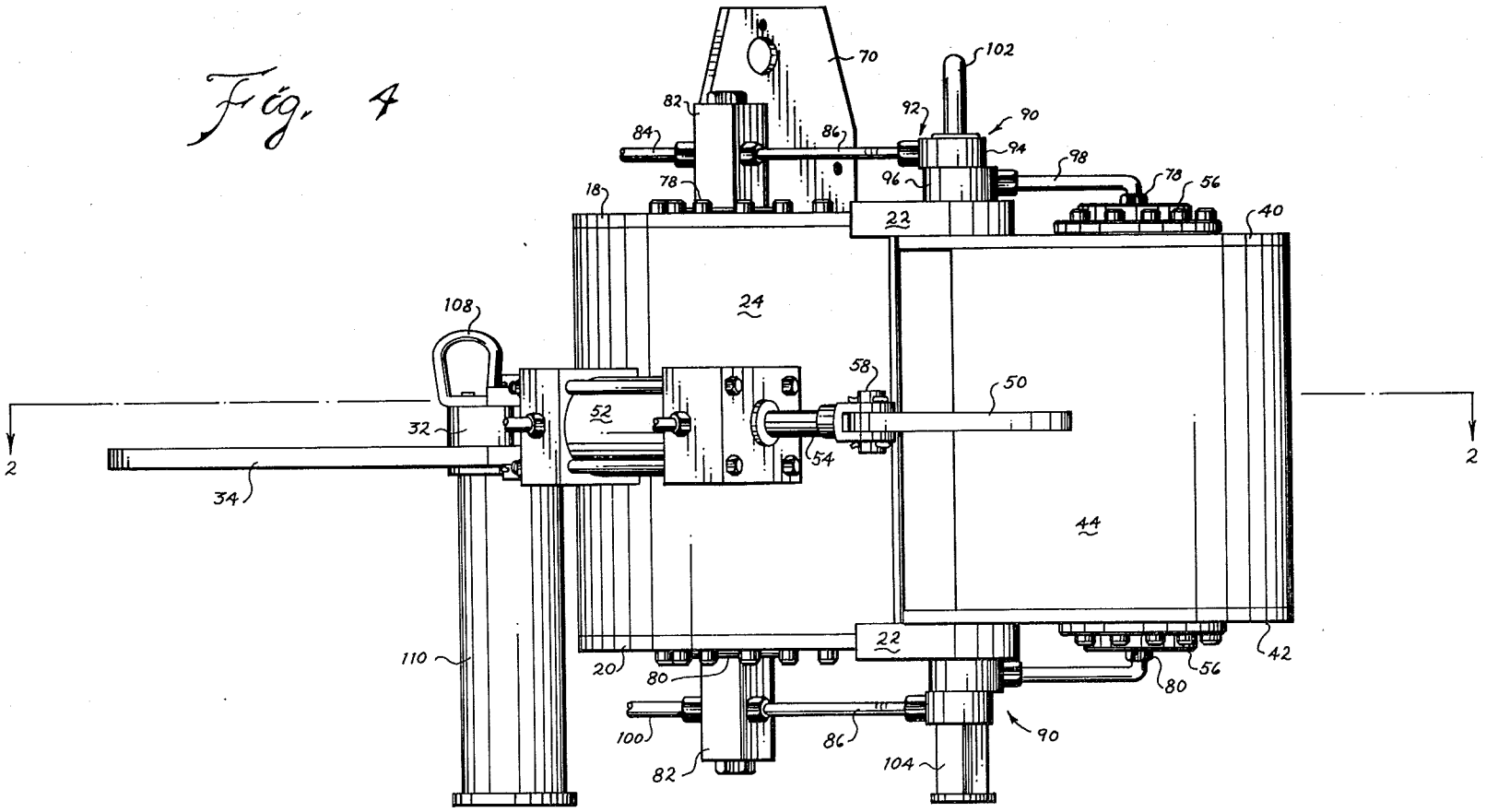
FIG. 4 is a side elevational view of the spinner.

Extending to the rear or outside of the main yoke to the central area is torque tab 32. It may be seen that the torque tab is made of a plate which is halfway between the top and bottom plates 18 and 20 (FIG. 4). Torque arm (not shown in FIG. 2 for clarity) 34 is bolted to the torque tab and has hole 36 in the end thereof for attaching a chain to the torque arm for exerting a torque upon the pipe spinner and, thus, the pipe P.

Swing arm 38 is attached to each pivot. Each swing arm also has top plate 40 and bottom plate 42 connected together by reinforced spacer 44. Also, pivot block 46 extends in the swing arms between the top plate 40 and the bottom plate 42. The pivot block 46 fits within the end of the heavy plates 22 on the end of each leg. Pivot shaft 48 extends through the hole in the thickened plate 22 on the end of the legs and through the pivot block 46. The swing arms 38 have cylinder ear 50 extending halfway between the top and bottom plates 40 and 42 and parallel thereto. Hydraulic cylinder 52 is attached to the torque tab 32. Hydraulic rod 54 extending from the hydraulic cylinder is attached to the cylinder ear 50.

Arm rotary hydraulic motor 56 is attached between the top and bottom plate 40 and 42 of each swing arm 38. As may be seen on the drawing, the axis of the hydraulic motor, the axis of the pivot and the axis of the cylinder ear pin 58 are aligned and parallel. Also, the outer housing of the arm rotary hydraulic motor 56 has the rollers 28 and 30 coaxially thereabout.

Central rotary hydraulic motor 60 is attached at the central area 12 of the yoke 10 between the top and bottom plates 18 and 20. The central hydraulic motor is co-axial with the central or main roller 26 which is thereabout. The axis of the central hydraulic motor is parallel to the axis of the arm rotary hydraulic motors 56 and obviously in use will also be parallel to the pipe P.

The left swing arm 38 is shown to be held rigidly in place by link arm 62. Those skilled in the art will recognize that a second hydraulic cylinder identical to hydraulic cylinder 52 could be used. The use of two hydraulic cylinders have certain advantages and certain disadvantages and the operators of this equipment, realizing both the advantages and disadvantages, may choose as to whether to use the link arm 62 or a second hydraulic cylinder 52. The link arm, which is provided, has clevis 64 which attaches to the torque tab 32. Turnbuckle 66 extends between the clevis 64 and adjustment plate 68. The adjustment plate, as may be seen, has a plurality of holes. By the use of selecting which holes in the adjustment plate 68 is pinned cylinder ear 50 and the adjustment of the turnbuckle 66 of the roller may be positioned as desired.

As stated before, the three rotary motors, 56 and 60, each have roller 26, 28 or 30 therearound. The rollers all have urethane coating on the exterior thereof to provide a tough friction contact with the pipe P.

Valve mounting plate 70 is attached to the left leg 16. Valve console 72 is attached thereto. Inasmuch as the valve console and details of the construction would be well within the skill of those having ordinary competency in hydraulic valves, it is not shown with any detail whatsoever. The function of the valve console is to receive hydraulic fluid under pressure from source 74 of hydraulic fluid under pressure and selectively actuate a height adjustment cylinder (not shown) or the hydraulic cylinder 52 or to operate the rotary hydraulic motors 56 or 60 either forward, reverse or neutral. It will be noted that the connection of the valve console 72 to the hydraulic cylinder 52 includes a load lock so that the hydraulic cylinder may be locked in any position desired. i.e., the hydraulic cylinder can be extended so that the pipe P is firmly clamped between the three rollers 26, 28 and 30 and the cylinder 52 locked into position so that it remains tightly locked therein with sufficient pressure so that there is sufficient friction between the pipe and the rollers to spin the pipe upon actuation of the rotary motors 56 and 60. The fluid conduits 76 connects the valve console to the hydraulic cylinder 52.

Each of the rotary motors has an axial inlet fluid connection 78 at the top thereof for receiving hydraulic fluid under pressure. Also, each of the rotary motors 56 and 60 have an axial outlet fluid connection 80 at the bottom thereof.

Figure 3:
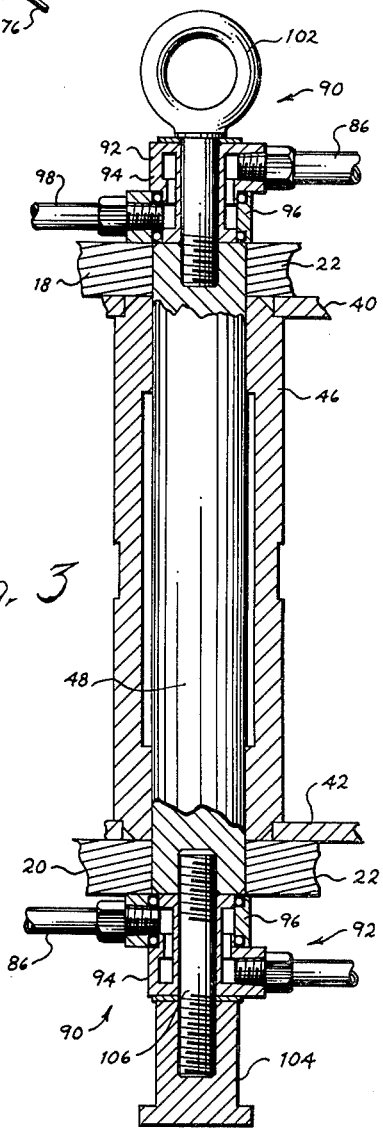
FIG. 3 is a sectional view of a pivot taken substantially on line 3—3 of FIG. 1.

Manifold 82 is attached on the top of the fluid inlet connection 78 of the central motor 60. Fluid conduit 84 supplies fluid under pressure from the valve console 72 to the manifold 82. The manifold 82 provides fluid to the inlet of the motor 60 and also provides fluid to right conduit 86 and left conduit 88. Right fluid conduit extends along right leg 14 to the hydraulic swivel 90 on the pivot at the right leg. Likewise, left fluid conduit 88 extends along the left leg to the hydraulic swivel 90 on that pivot. Each hydraulic pivot includes tubular body 92 (FIG. 3). The body has a fixed housing 94 attached thereto and a rotatable housing 96 attached thereto. The fluid conduits 86 and 88 are attached to the fixed housing 94 and arm fluid conduits 98 connect the rotatable housing 96 to the inlet 78 of the arm rotary hydraulic motor 56. Therefore, it may be seen that a flexible connection has been made at the pivot point to supply hydraulic fluid under pressure to the arm rotary hydraulic motors. In like manner, the axial outlet fluid connection 80 of each of the arm hydraulic motors 56 is connected through a hydraulic swivel 90 to manifold 82 on the bottom of the central hydraulic motor and from that manifold by outlet fluid conduit 100 to the valve console 72.

Front arm or front lifting eye 102 has its shank extending through the hydraulic swivel tubular body 92 and screwed into a tapped hole in the top of thepivot shaft 48 (FIG. 3). Arm or front foot 104 is attached by front foot shaft 106 through tubular body 92 of hydraulic swivel 90 on the bottom of pivot shaft 48. The front foot shaft is also threaded into a tapped hole in the bottom of the pivot shaft 48.

Yoke or back lifting eye 108 is attached to the rear of torque tab 32. Likewise rear foot 110 is attached to the bottom of the rear of torque tab 32.

Those skilled in the art will understand that the pipe spinner may be placed upon a floor and supported by the three feet 104 and 110 or that by use of bridle (not shown) connected from eyes 102 and 108 to the height adjustment cylinder (not shown), the pipe spinner may be hoisted to a desirable height.

Thus it may be seen that I have provided a pipe spinner which is compact, sturdy and flexible over a large range of pipe size.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | |
|---|---|
| Pipe - P | |
| 10 yoke | 62 link arm |
| 12 main central area | 64 clevis |
| 14 right leg | 66 turnbuckle |
| 16 left leg | 68 adjustment plate |
| 18 top plate | 70 valve mounting plate |

-continued

| | |
|---|---|
| 20 bottom plate | 72 valve console |
| 22 pivots | 74 source |
| 24 reinforced spacers | 76 fluid conduits (cylinder) |
| 26 main roller | 78 axial inlet fluid connection |
| 28 right roller | 80 axial outlet fluid connection |
| 30 left roller | 82 manifold |
| 32 torque tab | 84 fluid conduit (manifold inlet) |
| 34 torque arm | 86 right fluid conduit |
| 36 hole | 88 left fluid conduit |
| 38 swing arm | 90 hydraulic swivel |
| 40 top plate | 92 tubular body |
| 42 bottom plate | 94 fixed housing |
| 44 reinforced spacer | 96 rotatable housing |
| 46 pivot block | 98 arm fluid conduits |
| 48 pivot shaft | 100 outlet fluid conduit |
| 50 cylinder ear | 102 front lifting eye |
| 52 hydraulic cylinder | 104 front foot |
| 54 hydraulic rod | 106 front foot shaft |
| 56 arm hydraulic motor | 108 yoke or back lifting eye |
| 58 cylinder ear pin | 110 rear foot |
| 60 central hydraulic motor | |

I claim as my invention:

1. A pipe spinner for spinning pipe comprising:

a. a main yoke having a central area, b. a right leg angling forward and to the right of the central area, c. a left leg angling forward and to the left of the central area, d. a torque arm tab extending directly back from the central area, e. a torque arm bolted to the torque arm tab, f. a pivot at the extreme end of the right arm, g. a pivot at the extreme end of the left arm, h. a swing arm pivoted to each pivot, j. said swing arm having an ear extending on the outside, k. a rotary hydraulic motor on the pipe side of said swing arm, m. a hydraulic cylinder having one end pinned to the torque arm tab and having a rod extending from the other end, n. said rod pinned to the swing arm ear, o. said tab pin, said ear pin, said pivot and said rotary motor axis all being parallel, p. a rotary hydraulic motor at the central area of the yoke and the axis of all of said motors being parallel.

2. The invention as defined in claim 1 wherein q. an adjustable link arm extends from said torque tab to said ear on the outside of one of said swing arms.

3. The invention as defined in claim 1 further comprising:

q. said yoke including a top plate and a bottom plate, e. reinforcement spacers between said top plate and said bottom plate, s. said swing arms including a top plate below said yoke plate and a bottom plate above said yoke bottom plate and reinforcement spacers therebetween.

4. The invention as defined in claim 1 further comprising:

q. each of said rotary motors having a fluid inlet on the top thereof co-axial therewith, r. a fluid conduit extending from the swing arm rotary motors to the pivots, s. said conduit being flexible at said pivot and said fluid conduit extending to the central area motor, t. each of said rotary motors having a fluid outlet connection concentric therewith on the bottom of said pipe spinner, u. a fluid outlet connection attached from each of the swing arm rotary motors to said pivot, v. said outlet fluid connections being flexible at the pivot, w. said fluid connections extending from said pivot to said central area motor, x. a source of hydraulic fluid under pressure, y. a valve manifold, z. said source of hydraulic fluid under pressure connected to said valve manifold, aa. said valve manifold being a means for selectively furnishing hydraulic fluid under pressure to said hydraulic cylinder and to said three rotary motors.

5. The invention as defined in claim 4 further comprising:

bb. a manifold mounted on the top and bottom of said central area rotary motor coaxial therewith, cc. said manifold providing (i) a connection to said valve means, (ii) a fluid connection to said central area rotary motor, (iii) a fluid connection to said right leg pivot, and (iv) a fluid connection to said left leg pivot.

6. The inventin as defined in claim 4 wherein bb. said fluid inlet and outlet conduits to the swing arm motors are connected to a swivel connection attached to said pivot thereby achieveing said flexibility.

7. The invention as defined in claim 1 further comprising:

q. the outside of all of said motors having a roller attached thereto, r. a polyurethane coating on all of said rollers.

8. The invention as defined in claim 1 further comprising:

q. pivot pins at each pivot, r. a front lifting eye attached to each of said pivots above said pivot pins co-axial therewith, s. a rear lifting eye attached to said torque tab, whereby a bridle may be attached to said lifting eyes to lift said pipe spinner, t. a rear support foot below said rear lifting eye, u. a front support foot co-axial with each of said pivot pins, whereby the pipe spinner may be supported by said three feet.

9. The invention as defined in claim 8 further comprising:

v. the outside of all of said motors having a roller attached thereto, w. a polyurethane coating on all of said rollers.

10. The invention as defined in claim 9 further comprising:

x. each of said rotary motors having a fluid inlet on the top thereof co-axial therewith, y. a fluid conduit extending from the swing arm rotary motors to the pivots, z. said conduit being flexible at said pivot and said fluid conduit extending to the central area motor, aa. each of said rotary motors having a fluid outlet connection concentric therewith on the bottom of said pipe spinner, bb. a fluid outlet connection attached from each of the swing arm rotary motors to said pivot, cc. said outlet fluid connections being flexible at the pivot, dd. said fluid connections extending from said pivot to said central area motor, ee. a source of hydraulic fluid under pressure, ff. a valve manifold, gg. said source of hydraulic fluid under pressure connected to said valve manifold, hh. said valve manifold being a means for selectively furnishing hydraulic fluid under pressure to said hydraulic cylinder and to said three rotary motors.

11. The invention as defined in claim 10 wherein jj. said fluid inlet and outlet conduits to the swing arm motors are connected to a swivel connection attached to said pivot thereby achieveing said flexibility.

12. The invention as defined in claim 11 further comprising:

kk. a manifold mounted on the top and bottom of said central area rotary motor coaxial therewith, mm. said manifold providing (i) a connection to said valve means, (ii) a fluid connection to said central area rotary motor, (iii) a fluid connection to said right leg pivot, and (iv) a fluid connection to said left leg pivot.

13. The invention as defined in claim 12 further comprising:

nn. said yoke including a top plate and a bottom plate, oo. reinforcement spacers between said top plate and said bottom plate, pp. said swing arms including a top plate below said yoke plate and a bottom plate above said yoke bottom plate and reinforcement spacers therebetween.

14. The invention as defined in claim 13 wherein qq. an adjustable link arm extends from said torque tab to said ear on the outside of one of said swing arms.

* * * * *